US005765077A

United States Patent [19]

Sakurai et al.

[11] Patent Number: 5,765,077

[45] Date of Patent: Jun. 9, 1998

[54] CHARGING MEMBER, CHARGING DEVICE AND PROCESS CARTRIDGE DETACHABLY MOUNTABLE TO IMAGE FORMING APPARATUS

[75] Inventors: Kazushige Sakurai, Tokyo; Junichi Kato, Sagamihara; Kouichi Suwa, Yokohama; Masaki Ojima, Inagi; Hiroshi Sato; Satoru Inami, both of Tokyo; Tetsuya Sano, Yokohama, all of Japan

[73] Assignee: Canon Kabushiki Kaisha, Tokyo, Japan

[21] Appl. No.: 629,081

[22] Filed: Apr. 8, 1996

Related U.S. Application Data

[63] Continuation of Ser. No. 282,323, Jul. 29, 1994, abandoned.

[30] Foreign Application Priority Data

| | | | |
|---|---|---|---|
| Jul. 30, 1993 | [JP] | Japan | 5-208807 |
| Jul. 30, 1993 | [JP] | Japan | 5-208809 |
| Jul. 30, 1993 | [JP] | Japan | 5-208810 |
| Jul. 30, 1993 | [JP] | Japan | 5-208811 |
| Jul. 18, 1994 | [JP] | Japan | 6-165289 |

[51] Int. Cl.[6] ..... G03G 15/02

[52] U.S. Cl. ..... 399/176; 399/174; 361/225

[58] Field of Search ..... 399/174, 176; 361/225, 230; 442/57, 59

[56] References Cited

U.S. PATENT DOCUMENTS

| | | | |
|---|---|---|---|
| 4,967,231 | 10/1990 | Hosoya et al. | 355/219 |
| 5,038,174 | 8/1991 | Kato et al. . | |
| 5,089,851 | 2/1992 | Tanaka et al. | 361/225 X |
| 5,126,913 | 6/1992 | Araya et al. | 361/225 |
| 5,235,386 | 8/1993 | Yano et al. | 355/219 |
| 5,241,343 | 8/1993 | Nishio | 355/219 |
| 5,307,122 | 4/1994 | Ohno et al. | 355/219 X |
| 5,384,626 | 1/1995 | Kugoh et al. | 355/219 |
| 5,390,007 | 2/1995 | Kugoh et al. | 355/219 |
| 5,534,344 | 7/1996 | Kisu et al. | 428/323 |
| 5,543,899 | 8/1996 | Inami et al. | 399/176 |
| 5,576,805 | 11/1996 | Ishihara et al. | 399/176 |
| 5,666,606 | 9/1997 | Okano et al. | 399/174 |

FOREIGN PATENT DOCUMENTS

| | | | |
|---|---|---|---|
| 0308125 | 3/1989 | European Pat. Off. | 355/219 |
| 0410482 | 1/1991 | European Pat. Off. . | |
| 0526235 | 2/1993 | European Pat. Off. . | |
| 0526236 | 2/1993 | European Pat. Off. . | |
| 0541375 | 5/1993 | European Pat. Off. . | |
| 0568352 | 11/1993 | European Pat. Off. | 355/219 |
| 0572738 | 12/1993 | European Pat. Off. . | |
| 0579499 | 1/1994 | European Pat. Off. | 355/219 |
| 0587386 | 3/1994 | European Pat. Off. . | |
| 63-208878 | 8/1988 | Japan . | |
| 1066673 | 3/1989 | Japan . | |
| 1179957 | 7/1989 | Japan . | |
| 0240670 | 8/1992 | Japan | 355/219 |
| 0181349 | 7/1993 | Japan | 355/219 |
| 0210281 | 8/1993 | Japan | 355/219 |
| 0224506 | 9/1993 | Japan | 355/219 |
| 0265305 | 10/1993 | Japan | 355/219 |
| 0019277 | 1/1994 | Japan | 355/219 |
| 0130780 | 5/1994 | Japan | 355/219 |

OTHER PUBLICATIONS

Patent Abstracts of Japan, vol. 12, No. 499, Dec. 27, 1988.
Patent Abstracts of Japan, vol. 13, No. 276, Jun. 26, 1989.
Patent Abstracts of Japan, vol. 13, No. 460, Oct. 18, 1989.

*Primary Examiner*—Matthew S. Smith
*Attorney, Agent, or Firm*—Fitzpatrick, Cella, Harper & Scinto

[57] ABSTRACT

A charging member for charging a member to be charged includes a base member: a surface elastic member supported by the base member, the elastic member comprises a foamed member and a coating layer covering the foamed member; wherein a surface of the charging member has an Asker-C hardness of not more than 55 degrees and an international rubber hardness (IRHD) of not more than 80 degrees.

148 Claims, 13 Drawing Sheets

HARDNESS–NOISE PRESSURE
(FRQ=1500Hz)

| ASKER C HARDNESS | dB |
|---|---|
| 65° | 70 |
| 60° | 58 |
| 55° | 50 |
| 50° | 45 |
| 45° | 42 |
| 40° | 40 |
| 35° | 39 |

WALLACE HARDNESS VS. TONER DEPOSITION
(32.5°, 90%RH)

| HARDNESS | TONER DEPOSITION | IMPROPER CHARGING |
|---|---|---|
| 90° | ×× | Y |
| 85° | × | Y |
| 80° | △ | N |
| 75° | ○ | N |
| 60° | ○ | N |
| 55° | ○ | N |

FIG. 7

| | AREA RATIO (%) | ANGL (°) | HARD NESS (°) | VOL RES (Ωcm) | IMAGE |
|---|---|---|---|---|---|
| CNTR | | | 35 | $1\times10^{3}$ | G |
| EDGE | NOTAPER | | 20 | $1\times10^{5}$ | NG |
| ↑ | 95° | 20 | 25 | $1\times10^{4}$ | NG |
| ↑ | 90° | ↑ | 30 | $1\times10^{3}$ | G |
| ↑ | 80° | ↑ | 34 | $1\times10^{3}$ | G |
| ↑ | 70° | ↑ | 35 | $1\times10^{3}$ | G |
| ↑ | 80° | 3 | 25 | $1\times10^{4}$ | NG |
| ↑ | ↑ | 5 | 30 | $1\times10^{3}$ | G |
| ↑ | ↑ | 10 | 32 | $1\times10^{3}$ | G |
| ↑ | ↑ | 20 | 34 | $1\times10^{3}$ | G |
| ↑ | ↑ | 30 | 35 | $1\times10^{3}$ | G |

FIG. 10

| MAX. DIA. (mm) | DEPTH (μm) | IMAGE EVALUATION |
|---|---|---|
| 1 | 200 | G |
| 2 | 100 | G |
| 3 | 150 | G |
| 3 | 200 | G |
| 3 | 300 | G |
| 4 | 100 | G |
| 4 | 200 | G |
| 5 | 130 | G |
| 5 | 250 | G |
| 5 | 320 | G |
| 6 | 90 | F |
| 6 | 100 | F |
| 7 | 150 | NG |
| 8 | 200 | NG |
| 8 | 250 | NG |
| 9 | 190 | NG |
| 10 | 300 | NG |
| 11 | 200 | NG |

FIG. 14

| MAX. DIA. (mm) | DEPTH (μm) | IMAGE EVALUATION |
|---|---|---|
| 2 | 80 | G |
| 2 | 140 | G |
| 3 | 150 | G |
| 3 | 110 | G |
| 3 | 180 | G |
| 4 | 70 | G |
| 5 | 200 | G |
| 5 | 160 | G |
| 5 | 250 | G |
| 5 | 300 | F |
| 6 | 90 | F |
| 6 | 100 | NG |
| 7 | 130 | NG |
| 8 | 200 | NG |
| 8 | 220 | NG |
| 9 | 160 | NG |

FIG. 16

| MAX. DIA. (mm) | DEPTH (μm) | IMAGE EVALUATION |
|---|---|---|
| 1 | 180 | G |
| 3 | 210 | G |
| 3 | 200 | G |
| 4 | 80 | G |
| 4 | 390 | G |
| 5 | 200 | G |
| 5 | 230 | G |
| 5 | 290 | G |
| 6 | 80 | G |
| 6 | 100 | G |
| 7 | 180 | G |
| 8 | 210 | NG |
| 8 | 320 | NG |
| 9 | 110 | NG |
| 9 | 150 | NG |
| 10 | 300 | NG |
| 11 | 300 | NG |

FIG. 18

CHARGING MEMBER, CHARGING DEVICE AND PROCESS CARTRIDGE DETACHABLY MOUNTABLE TO IMAGE FORMING APPARATUS

This application is a continuation of application Ser. No. 08/282,323, filed Jul. 29, 1994, now abandoned.

FIELD OF THE INVENTION AND RELATED ART

The present invention relates to a charging member and charging device for charging a member to be charged such as an image bearing member, and a process cartridge detachably mountable to an image forming apparatus.

In a contact charging type, a charging member supplied with a voltage is contacted to an image bearing member (photosensitive drum) to directly transfer electric charge to the photosensitive drum to charge the surface thereof to a predetermined potential. As compared with a widely used corona discharger, the contact type is advantageous in that the voltage required for providing a predetermined potential on the photosensitive drum surface can be reduced, that an amount of ozone produced through the charging process is so small that the necessity for the filter for removing ozone is eliminated, that the structure of the exhausting system can be simplified, correspondingly, that no maintenance is required, that the structure is simple, and so on.

For this reason, it is particularly noted as a means replaceable with corona discharger to charge an image bearing member such as a photosensitive member or the dielectric member or another photosensitive member.

In the contact charging method or apparatus, there is a type in which an oscillating voltage in the form of a DC biased AC voltage is applied to the contact charging member, and such a contact charging member is contacted to a photosensitive drum for the purpose of uniform charging operation.

FIG. 22 shows an example thereof, in which reference numeral 1 designates a photosensitive drum, which is rotated in a predetermined namely in the clockwise direction R1 at a predetermined peripheral speed (process speed). It may be an electrophotographic photosensitive member or electrostatic recording dielectric material or the like.

Designated by a reference numeral 2 is a conductive roller (charging roller) as the contact charging member. The charging roller 2 comprises a solid type rubber such as a urethane rubber, EPDM or the like having an electroconductivity, as designated by a reference numeral **2*r*. The hardness thereof is 60–70 degrees (Asker-C). The charging roller 2 is press-contacted to the surface of the photosensitive drum 1 at a predetermined pressure provided by springs 3 at the opposite end portions of the core metal 2*a*. It is rotated by rotation of the photosensitive drum 1 in a direction R2. The charging roller 2 is supplied with a voltage 4, which supplies through a contact leaf spring (not shown) contacted to the core metal 2*a* of the charging roller 2, a voltage (Vac+Vdc) which is a DC voltage Vdc superimposed with an oscillating voltage Vac having a peak-to-peak voltage Vpp which is not less than twice a charge starting voltage of the photosensitive drum 1. By doing so, the outer peripheral surface of the rotating photosensitive drum 1** is uniformly charged.

The charging roller involves the following problems. The solid type charging roller has a high hardness with the result that a part of the charging roller is apart from the photosensitive drum with the result of improper charging. Such improper charging tends to occur in the central portion in the longitudinal direction of the charging roller.

When the oscillating voltage is applied charging noise occurs by beating action between the charging roller and the photosensitive drum, and the charging noise is uncomfortable.

As a method of reducing the charging noise, there is a means of packing metal or the like in the photosensitive drum, with the result of the problem from the standpoint of weight and the cost.

SUMMARY OF THE INVENTION

Accordingly, it is a principal object of the present invention to provide a charging member, a charging device and a process cartridge in which the hardness of the charging member is reduced.

It is another object of the present invention to provide a charging member, a charging device and a process cartridge in which the contact relative to the member to be charged is stabilized to permit satisfactory charging operation.

It is a further object of the present invention to provide a charging member, a charging device and a process cartridge in which the charging noise is reduced.

It is a yet further object of the present invention to provide a charging member, a charging device and a process cartridge in which the elastic member of the charging member comprises a foamed material.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 is a graph showing a relationship between a Wallace hardness and toner fusion.

FIG. 10 is a table showing a relationship between a magnitude and an angle of a tapered portion and a hardness and volume resistivity.

FIG. 14 is a table illustrating a relationship between a maximum diameter of depth of the voids and evaluation of image quality, in the same Figure.

FIG. 16 shows a relationship between a maximum diameter and depth of the voids and an image quality evaluation.

FIG. 18 shows a relationship between a maximum diameter and depth of the voids and an image quality evaluation.

DESCRIPTION OF THE PREFERRED EMBODIMENTS

Referring to the accompanying drawings, the embodiments of the present invention will be described.

Figure 1:
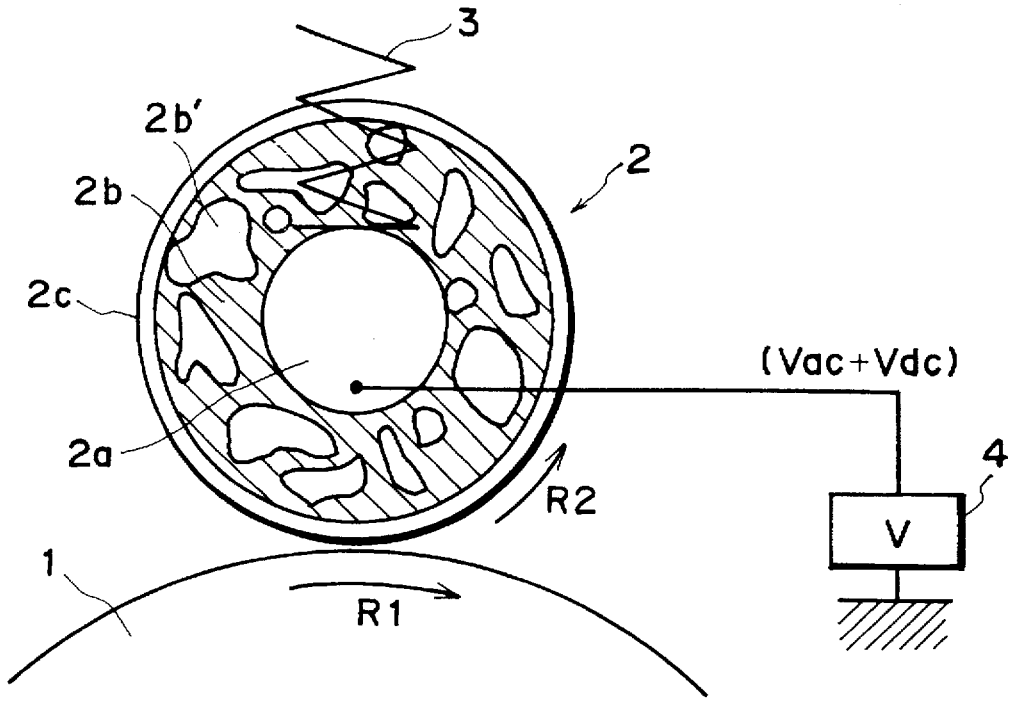
FIG. 1 is a schematic cross-sectional view of a charging member according to a first embodiment of the present invention.

FIG. 1 is a cross-sectional view of a charging roller 2 as an exemplary charging member according to an embodiment of the present invention.

Figure 2:
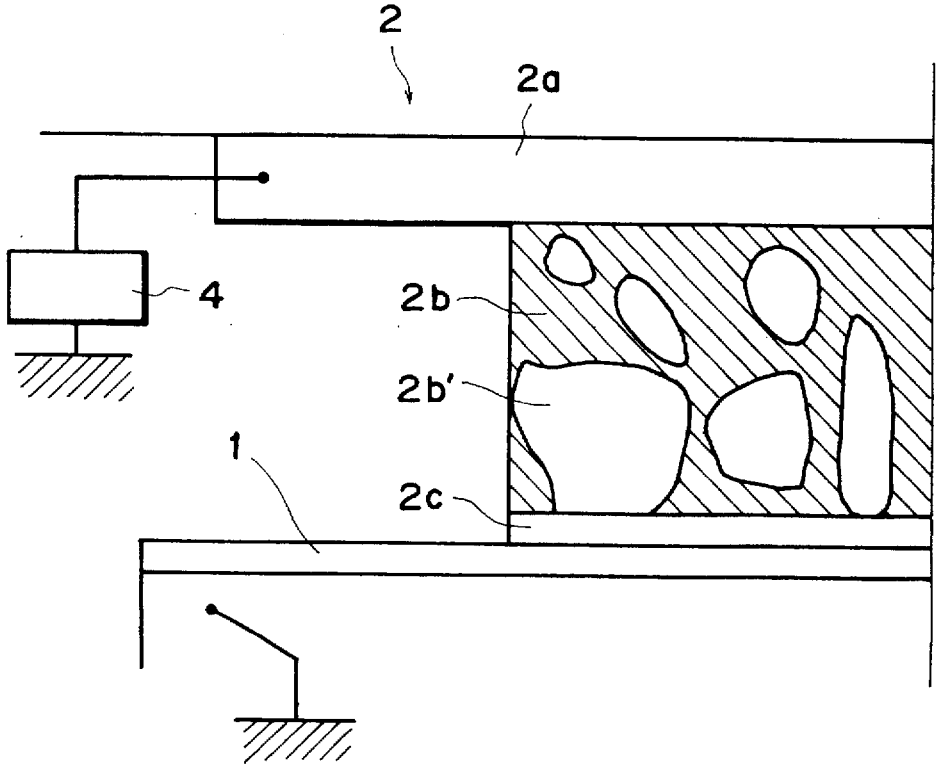
FIG. 2 schematically shows a longitudinal sectional view of a portion adjacent to an end of the charging member.

FIG. 2 is a partial longitudinal sectional view adjacent a longitudinal end thereof.

Designated by reference numeral 1 is a rotatable photosensitive drum of a positive or negative charging property. Designated by reference numeral 2 is a charging roller as a contact charging member. The charging roller 2 comprises a core metal 2*a* of stainless steel as a supporting member, a foamed material (foamed layer) 2*b* integrally formed on the outer peripheral surface of the core metal 2*a* concentrically, and an intermediate resistance electroconductive tube 2*c* on the outer peripheral surface of the foamed material 2*b*.

Figure 3:
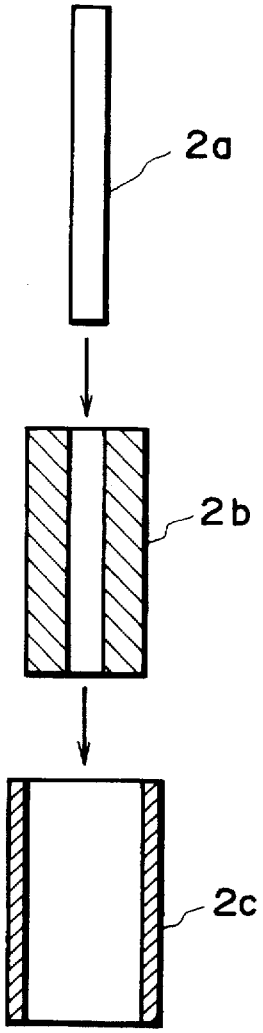
FIG. 3 illustrates manufacturing method of the charging roller.

Such a charging roller may be produced through a method in which the foamed member 2*b* is first manufactured, and the core metal 2*a* and a tube 2*c* are inserted (FIG. 3), or a method in which a core metal 2*a* is erected within the tube 2*c*, and the material for the foamed member 2*b* is filled around the core metal 2*a*, and then the material is foamed with the tube and the core metal fixed (FIG. 4), or the like. With the former method, waving or deviation or the like may occur when the material is inserted, and therefore, it is difficult to provide stabilized images. For this reason, the charging roller is produced through the latter method in this embodiment.

The tube 2*c* covering the conductive foamed member 2*b* is substantially separated from the electroconductive foamed member 2*b*. The same applies to between the core metal 2*a* and the electroconductive foamed member 2*b*. In order to prevent the deviation in the axial direction, tube 2*c* and the foamed material 2*b* may be partly fixed to each other, and the core metal 2*a* and the foamed material 2*b* may be partly fixed to each other. As a result, even if an oscillating voltage is applied to the core metal 2*a*, the heavy core metal 2*a* does not vibrate, but only the light foamed member 2*b* and the tube 2*c* are only vibrated to beat the photosensitive drum 1, and therefore, the beating energy is small with the result of smaller charging noise. The surface of the foamed material 2*b* is not smooth because of cells on the surface thereof, but the improper charging can be avoided by covering it with the tube 2*c* having good surface property.

In addition, the tube 2*c* is harder than the electroconductive foamed member, so that deformation of the charging roller due to an external force can be avoided.

However, such a charging roller 2 results in toner fusion on the surface of the charging roller because of the hardness of the tube 2*c* particularly under high temperature and high humidity ambient condition (32.5° C. and 90%). The improper charging occurs by the local resistance increase caused by the fusion. This is another problem.

The description will be made as to relationships among Asker-C hardness of the charging roller (charging member), international rubber hardness standard hardness of the tube, the charging noise, and the toner fusion.

Figures 5, 6:
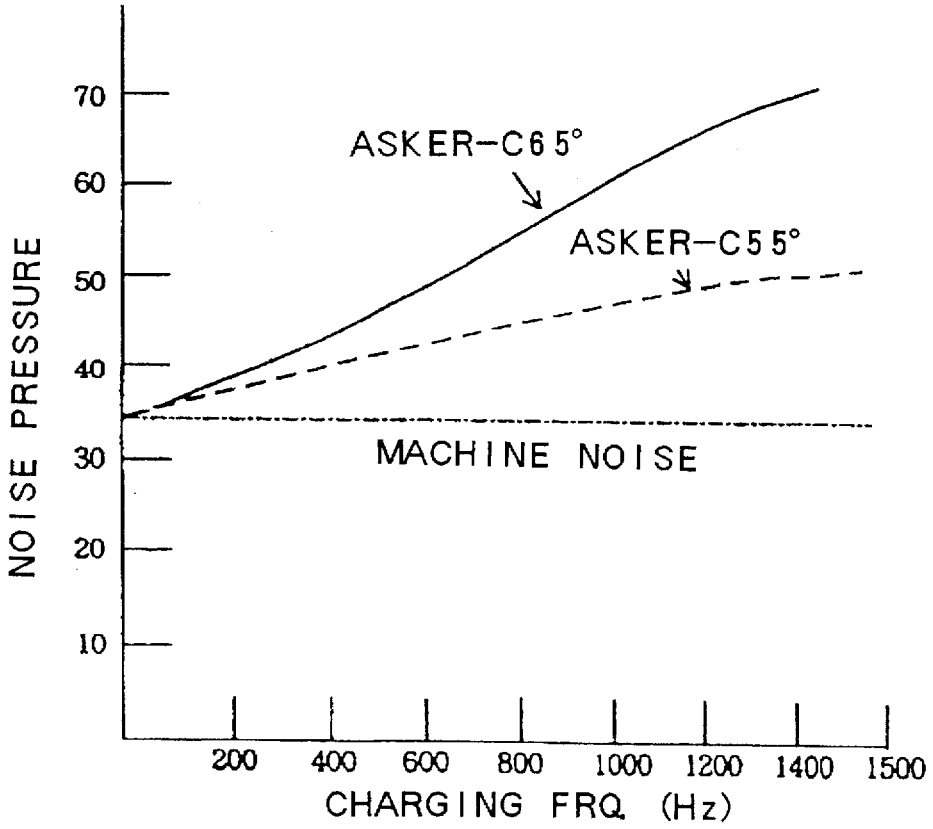
FIG. 5 is a graph showing a relationship between Asker-C hardness and a charging noise.
FIG. 6 is a graph showing a relationship between a charging frequency and a noise level.

As regards the charging noise, interrelations are recognized between the noise pressure of the charging noise and the Asker-C hardness of the charging roller, and more particularly, the noise pressure of the charging noise can be reduced if the Asker-C hardness is reduced. This is because the vibration energy of the charging member reduces with reduction of the Asker-C hardness. When the frequency of the oscillating voltage applied to the charging member, which will hereinafter be called (charging frequency), is 1500 Hz, the relationship between the Asker-C hardness and the charging noise pressure, is as shown in FIG. 5. The relationship between the charging frequency and the noise pressure when the Asker-C hardness is 65 degrees and 55 degrees, is as shown in FIG. 6. From FIGS. 5 and 6, it will be understood that if Asker C hardness is not more than 55 degrees, the charging noise level can be suppressed below 50 dB up to 1500 Hz of the charging frequency. According to the investigations of the inventors, the charging noise is not uncomfortable in the normal printing operation if the charging noise level is not more than 50 dB.

As regards the toner fusion, an interrelation is recognized between the toner fusion on the charging member during long term operation and a microhardness of the charging mender surface (the hardness of the tube). More particularly, the amount of toner fusion is small if the microhardness is small. The reason for this is considered as resulting from the cause of the toner fusion. More particularly, when the residual toner on the photosensitive drum not completely removed by the cleaning device and the toner scattered in the main assembly of the apparatus, are deposited on the surface of the charging roller, the toner is rubbed at the contact portion with the photosensitive drum if the microhardness on the surface of the charging roller is high, with the result of the toner fusion thereon.

FIG. 7 shows an interrelation between the toner fusion and the hardness under the international rubber hardness standard IRHD, measured by Wallace microhardness meter, available from H. W. Wallace and Co. Ltd. From FIG. 7, it will be understood that the problem of the toner fusing can be avoided if the Wallace hardness is not higher than 80 degrees.

The description will be made referring to the drawings.

In FIGS. 1 and 2, the foamed member 2*b* comprises a foamed material such as polystyrene, polyolefine, polyester, polyurethane or polyamide material or a soft material such as EPDM (ethylene propylene diene terpolymer) or urethane material, in which electroconductive powders such as carbon or tin oxide are dispersed to provide the proper volume resistivity. In this embodiment, the use is made with foamed polyurethane material in which carbon is dispersed Designated by 2*b*' are cells, filled with air, nitrogen, argon gas or the like.

As for the conductive tube, fluorine resin material such as urethane resin, polyester resin, polyethylene resin, TFA resin (perfluoroalkoxy), FEP, PTFE (polytetrafluoroethylene resin), or synthetic rubber such as EPDM, styrene butadiene rubber or the like, in which electroconductive particles such as conductive carbon, tin oxide, titanium oxide, indium oxide or the like, and the materials are mixed and kneaded, thereafter, the tube is foamed through extrusion or the like In this embodiment, the use is made with polyester urethane resin material in which carbon is dispersed.

Specifications of the charging roller 2 in this embodiment are as follows:

Core metal 2*a*: 6 mm in diameter, 260 mm in length and made of stainless steel round rod Foamed material 2*b*: carbon dispersed foamed polyurethane material having a volume resistivity of $10^2$–$10^6$ ohm·cm and having a layer thickness of 2.5 mm and a length of 230 mm Tube 2*c*: thermoplastic polyurethane elastomer having a volume resistivity of $10^3$–$10^9$ ohm·cm and a layer thickness of 250 μm Weight of charging roller 2: 68 g The Asker-C hardness of the charging roller was 42 degrees, and the Wallace hardness was 70 degrees. From the standpoint of avoiding improper charging in the form of stripe non-uniformity due to current leakage from the charging roller 2 to the photosensitive drum, the volume resistivity of the tube 2*c* is preferably larger than that of the foamed member 2*b*.

Figure 22:
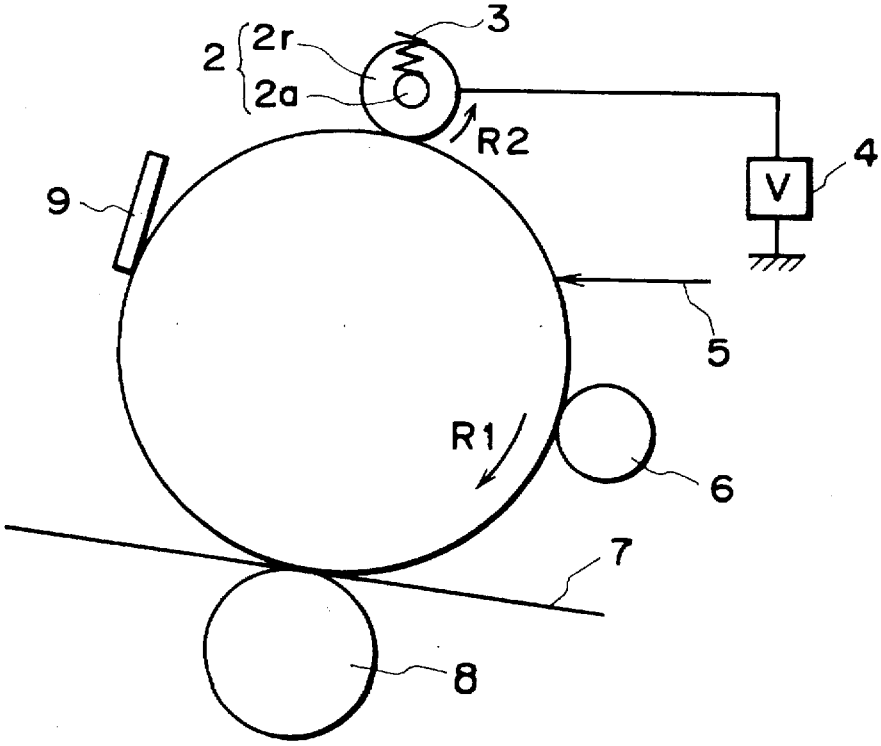
FIG. 22 shows a structure of conventional charging roller.

Similarly to the conventional charging roller shown in FIG. 22, the charging roller 2 of this embodiment is supported by an unshown bearings at the opposite longitudinal ends of the core metal 2*a*, and is urged to the photosensitive drum by a compression spring 3 to provide a predetermined urging force against the surface of the photosensitive drum (total pressure of 1000 g) in this embodiment. It is rotated by the rotation of the photosensitive drum 1. The charging roller 2 is supplied from a voltage source 4 through a sliding electrode (not shown) contacted to the core metal 2*a* of the charging roller, with the superimposed oscillating voltage (Vac+Vdc) of the following:

AC voltage: 2.0 KVpp, 1500 Hz

DC voltage: DC voltage corresponding to a target charging potential. By doing so, the peripheral surface of the rotating photosensitive drum 1 is uniformly charged to the target potential through AC charging process.

The noise level of the charging roller of this embodiment and a conventional internal solid type charging roller, have been measured.

An example of the conventional charging roller 2 had the following specifications:

Core metal 2*a*; 6 mm in diameter, 260 mm in length made of stainless steel round rod Rubber roller 2*r*: carbon dispersed solid EPDM conductive rubber, having a volume resistivity of $10^5$ ohm·cm, a layer thickness of 2.8 mm and a length of 230 mm.

Weight of the charging roller: 120 g

The Asker-C hardness of the charging roller was 62 degrees.

The contact charging device of this embodiment is placed in anechoic chamber, and the charging noise was measured under the above-described voltage application. The measurements were carried out under paragraph 6 of ISO 7779. The results show that the charging noise with the conventional solid integral charging roller was 68 dB, and that of the charging roller of this embodiment was as low as 41 dB. The charging noise reduction effect can be provided irrespective of whether the cells of the foamed material are independent or open.

The charging roller of this embodiment is incorporated in a laser beam printer, and the durability test run for image formation was carried out under high temperature and high humidity ambient condition (32.5° C., 90%) up to 6000 A4 sheets. As a result, no toner fusion on the surface of the charging roller was observed, and improper image quality due to improper charging did not occur.

As will be understood from the foregoing, the charging noise can be sufficiently reduced if the Asker-C hardness is not higher than 55 degrees, and IRHD hardness is not higher than 80 degrees. In addition, by doing so, the toner fusion on the surface of the charging roller can be avoided without uncomfortable noise. In addition, a high quality image can be provided.

Embodiment 2

Figure 8:
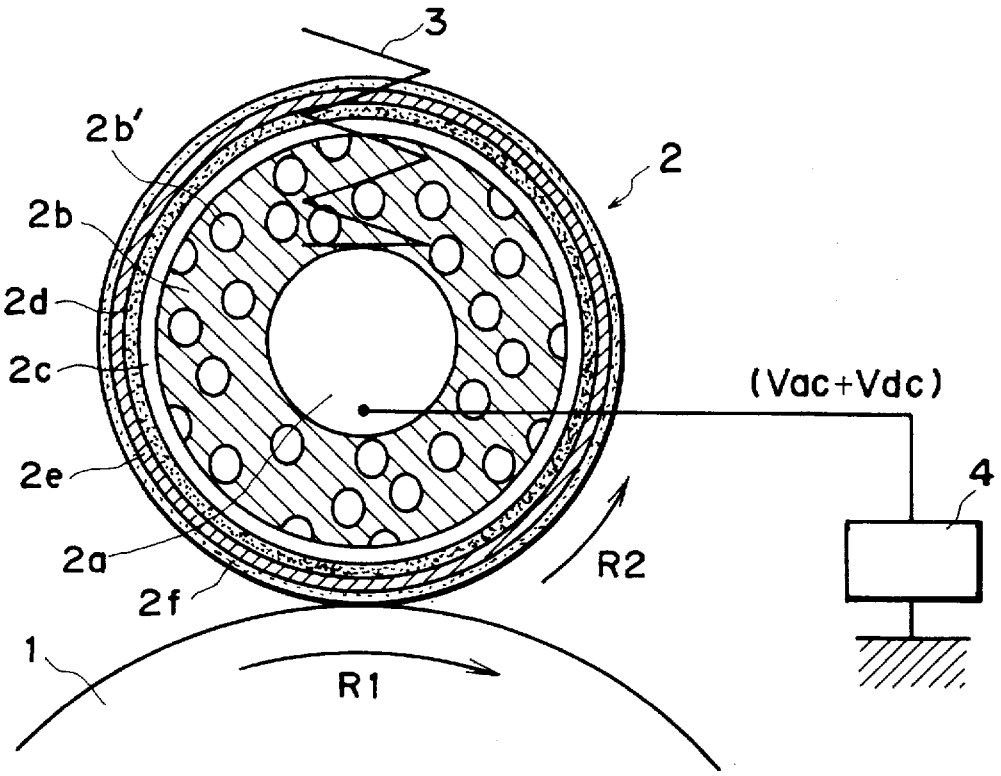
FIG. 8 is a cross-sectional view of a charging member according to a second embodiment of the present invention.

In this embodiment, the charging roller 2 comprises the electroconductive foamed member 2*b*, an intermediate resistance tube 2*c* thereon, a conductive layer 2*d* thereon, an intermediate resistance layer 2*e* and a protection layer 2*f* thereon. FIG. 8 is a cross-sectional view of a charging roller according to this embodiment.

The protection layer 2*f* on the intermediate resistance layer 2*e* is selected in consideration of the relation with the surface layer of the photosensitive drum 1 such that the contamination of the photosensitive drum 1 and the charging roller 2 can be avoided. Examples of the material of the protection layer include electroconductive powder dispersed resin material such as N-methoxymethyl nylon, polyvinylbutyral resin, polyvinylchloride resin, polyvinyl alcohol resin, ethylenevinyl acetate resin, polyurethane resin, acrylic resin or the like. In this embodiment, carbon dispersed N-methoxymethyl nylon was used.

Figure 9:
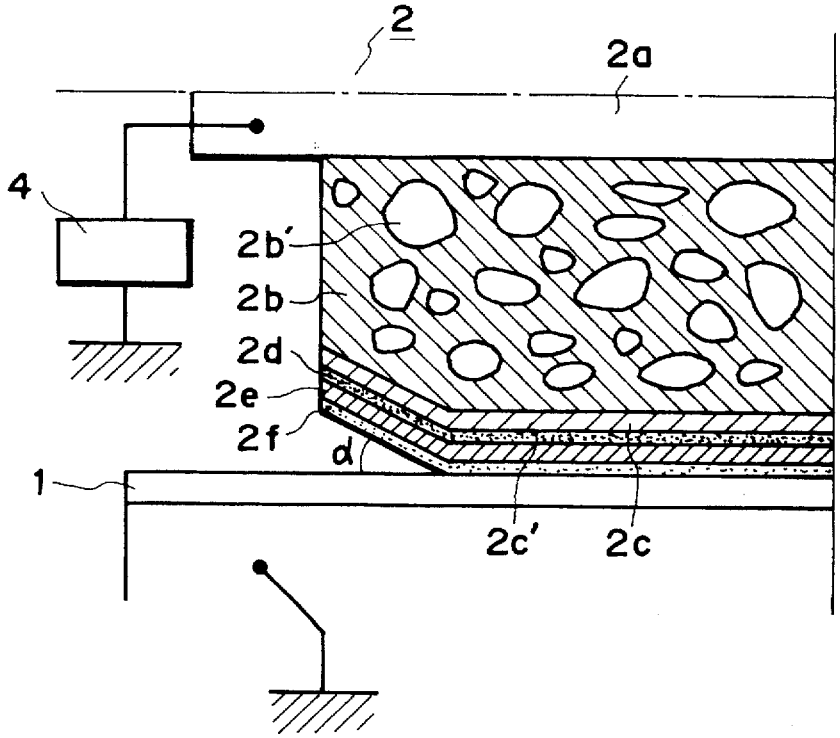
FIG. 9 is a schematic longitudinal sectional view of a portion adjacent an end of the charging member.

In this embodiment, as shown in FIG. 9, a taper portion 2*c*' is provided at each longitudinal end of the tube 2*c*.

When the foaming material is foamed in the tube without the tapers 2*c*' (FIG. 4), the pressure resulting from the foaming of the foaming material is significantly low at the end portions as compared with the longitudinally central portion of the tube 2*c*. The reason is as follows. In the longitudinally central portion of the tube 2*c*, the foaming takes place in virtually closed space. On the contrary, at the and portion, it is not closed, and therefore, the foaming pressure in the tube decreased there. The foamed material produced by the low foaming pressure tends to acquire larger cells in the material, with the result of lower hardness of the foamed material, and therefore, a larger volume resistivity.

By the provision of the taper 2*c*' at each longitudinal end portion of the tube 2*c*, the opening is reduced, thus preventing escape of the foaming material, and providing pressure urging the material toward the longitudinally central portion by the inside wall surfaces of the taper 2*c*'. By foaming the material in the tube 2*c* with such tapers 2*c*' at the opposite ends, the foaming pressure can be provided which is substantially uniform at the central portion and the end portions, and therefore, the sizes of the calls in the foamed material are uniform along the entire length. When the sizes of the inside cells are uniform, the hardness and the volume resistivities are equally uniform. By charging the photosensitive drum using the charging member produced in this manner, the surface potential of the photosensitive drum is uniform, and therefore, good images can be provided without charging non-uniformity.

FIG. 10 shows results of experiments carried out to determine the proper range of the tapered portion. The size of the tapered portion 2c' is represented as a ratio of a cross-sectional area of the end opening to a cross-sectional area of the tube 2c in the longitudinally central portion thereof, and an angle a (FIG. 9) of the tapered portions 2c' relative to the surface of the photosensitive drum. As the effects, the hardness and the volume resistivity of the foamed member 2c at the longitudinal end portions of the tube 2c, and the image qualities are evaluated. As will be understood from FIG. 10, uniform images can be provided if the opening area at the end is not more than 90% relative to the cross-sectional area in the central part, more preferably, it is not more than 80%. By doing so, the hardness, the volume resistivity of the foamed material 2b is uniform in the longitudinal and circumferential directions, so that further stabilized charging is enabled. As to the angle α, if it is not less than 5 degrees, non-uniform can be provided, and more preferably, if it is not less than 20 degrees, the hardness and the volume resistivity of the foamed member 2b is uniform in the longitudinal and circumferential directions, and therefore, further stabilized charging is enabled.

The specifications of this embodiment are as follows:

Foamed member 2b: carbon dispersed foamed epichlorohydrin rubber having a volume resistivity of $10^2$–10 ohm·cm and having a layer thickness of 2.5 mm and a length of 230 mm.

Tube 2c: polyester urethane thermoplastic elastomer having a volume resistivity of $10^3$–$10^9$ ohm·cm and having a layer thickness of 250 μm.

Electroconductive layer 2d: N-methoxymethyl nylon in which conductive powder such as carbon or tin oxide or the like is dispersed having a volume resistivity of $10^1$–$10^6$ ohm·cm and having a layer thickness of 10 μm.

Intermediate resistance layer 2e: epichlarohydrin rubber having a volume resistivity of $10^7$–$10^{10}$ ohm·cm having a layer thickness of 200 μm.

Protection layer 2f: N-methoxymethyl nylon having a volume resistivity of $10^7$–$10^{12}$ ohm·cm and having a layer thickness of 5 μm.

Weight of charging roller 2: 70 g

The Asker-C hardness of the charging roller 2 was 48 degrees, and the Wallace hardness was 75 degrees.

Using the charging roller 2, the charging noise was produced in the same manner as in Embodiment 1, and the image forming test run was carried out under high temperature and high humidity condition. The measured charging noise was as small as 44 dB. In the image forming test run, no toner fusion occurs onto the charging roller 2 surface, and therefore, the foamed images were satisfactory, as in Embodiment 1.

Embodiment 3

In this embodiment, similar charging roller 2 as in Embodiment 2 was used, but a tensile stress of the tube 2c was changed, and a plastic deformation (permanent set in fatigue) was checked.

Since the charging roller 2 is pressed to the photosensitive drum 1, the deformation thereof increases with increase of the softness of the foamed member 2b of the charging roller 2. If the charging roller 2 does not restore, the rotation of the charging roller becomes non-uniform because of the permanent deformation with the result of improper charging or blurred images.

Since the charging roller 2 of this embodiment is provided with a tube 2c covering the foamed member 2b, and therefore, the plastic deformation does not easily occur, and it depends on the tensile stress of the tube 2c. These have been found through experiments.

Figure 11:
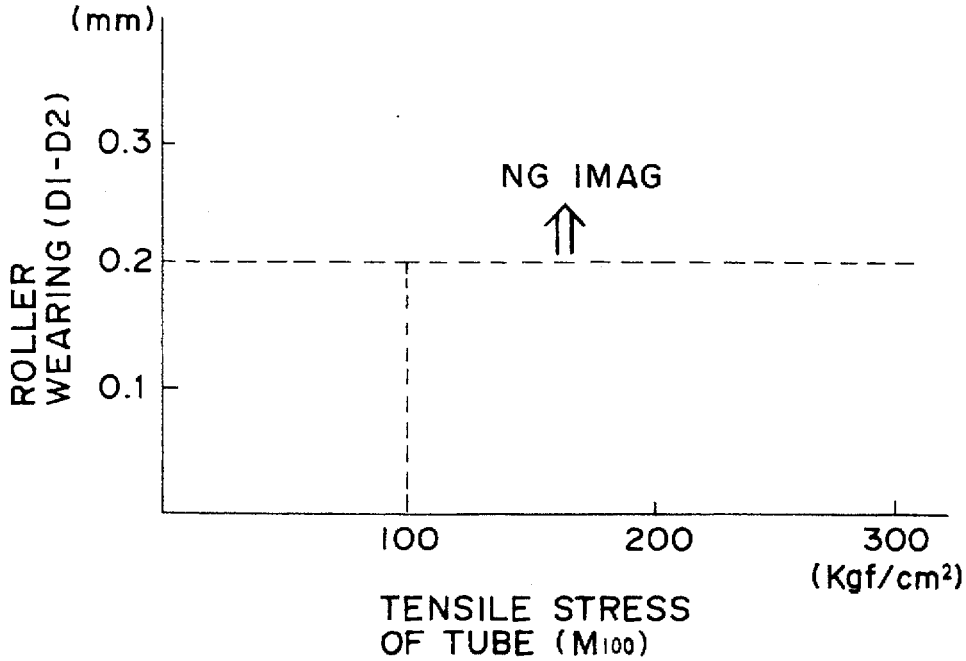
FIG. 11 is a graph showing a relationship between a tensile stress of a tube and a wearing amount of the charging roller, in a third embodiment of the present invention.

The amount of fatigue of the charging roller is measured when the tensile stress of the tube 2c is changed in the charging roller 2 of the second embodiment. FIG. 11 shows the results with evaluation of the images.

The tensile stress is measured in the following manner. The use is made with a sample material of the same material as the tube having a thickness of 0.2 mm and a width of 10 mm. It was pulled in a distance of 50 mm. The measurement is carried out using a tensile tester. The pulling speed was 50 mm/min constant. The load was read at the point of time when the elongation reaches 100% (F100). The tensile stress M100 is defined as the value divided by the cross-sectional area, namely, $$\mathbf{M100}\ (\mathrm{kgf/cm^2}) = \mathbf{F100}\ (\mathrm{kgf})/\text{cross-sectional area of the material}\ (\mathrm{cm^2}) \quad (1)$$

Figure 12:
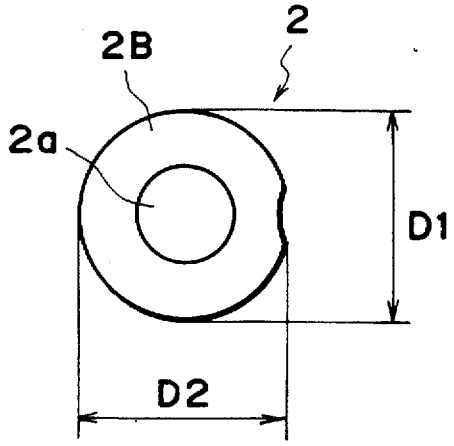
FIG. 12 illustrates the amount of wearing.

As for the measurement of the amount of fatigue, the outer diameter (D1) of the charging roller 2 is measured, and the charging roller is pressed against the photosensitive drum 1 with a total pressure of 1000 g. They are left as it is for one month under 40° C. and 95% humidity ambience. Thereafter, the diameter d2 as shown in FIG. 12 is measured. The amount of fatigue is defined as (d1–d2).

From the results of the experiments, it is understood that the amount of fatigue of the charging roller 2 decreases with increase of the tensile stress M100 of the tube 2c. This is because the high tensile stress or strength tube 2c is provided, and therefore, the force produced by the urging of the charging roller 2 to the photosensitive drum 2 is distributed to wide area in the tube 2c so that local deformation of the charging roller 2 at the contact portion is reduced. With the decrease of the amount of fatigue, the improper charging or image blurness can be reduced correspondingly, In this embodiment, the amount of fatigue not resulting in the improper image formation is 0.2 mm or lower, and the tensile stress M100 of the tube 2c satisfying this is 100 kgf/cm$^2$ or higher.

As described, by using for the tube 2c the material having the tensile stress M100 of not less than 100 kgf/cm$^2$, the charging roller 2 can exhibit small amount of fatigue and good surface property, and therefore, the charging noise can be sufficiently reduced. In addition, the improper charging can be prevented.

Embodiment 4

Figure 4:
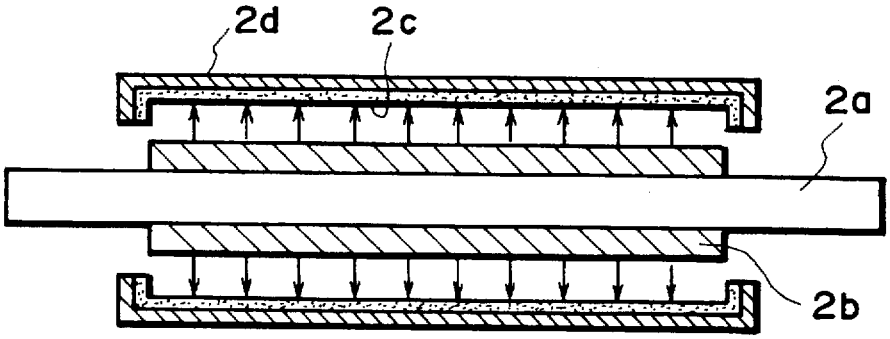
FIG. 4 illustrates a manufacturing method of the charging roller.

In this embodiment, the charging roller 2 is manufactured by foaming a foaming material as described in conjunction with FIG. 4. In this case, there is no way of air escape at the interface with the tube with the result that the air remains as a great number of bubbles, which will hereinafter be called "voids". This is not recognized from the outer appearance. However, the following has been found. When this charging member is contacted to the photosensitive drum and the photosensitive drum is rotated, residual toner not having been removed by the cleaning blade enters between the charging member to the photosensitive drum, and the residual toner may stagnate in the voids with the result of improper charging and black spots on the image.

It will be possible to remove the voids by abrading the elastic surface of the formed material. However, the difficulty will arise then, in that the straightness in the longitudinal direction is difficult to maintain, and in addition the manufacturing cost is increased. In this embodiment, the foamed material is provided with an integral skin layer at the surface thereof, and therefore, the cells of the foamed material are not exposed to the outside. In this sense, the void is distinguished from call In this embodiment, various configurations of voids 2 g are foamed in the charging roller 2 having the structure of the second embodiment, and durability test run is carried out to evaluate image quality including improper charging, for 10,000 sheets.

Figure 13:
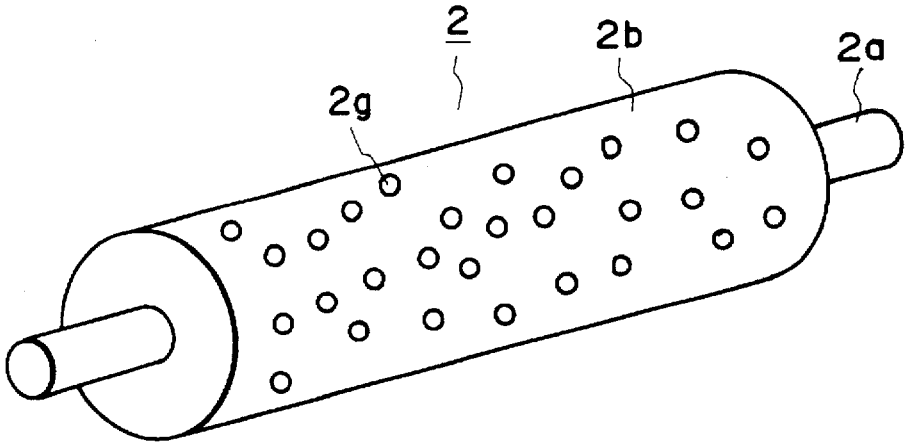
FIG. 13 is a perspective view illustrating voids appearing in a surface of a foamed material in a fourth embodiment.

In the case of FIG. 13, the voids 2 g have substantially circular configuration. FIG. 14 shows the results of experiments. From this Figure, it will be understood that the improper charging is rather dependent upon the outer diameter than the depth of the voids 2*g*. Furthermore, it will be understood that if the outer diameter is not more than 5 mm, the improper charging does not occur.

Figure 15:
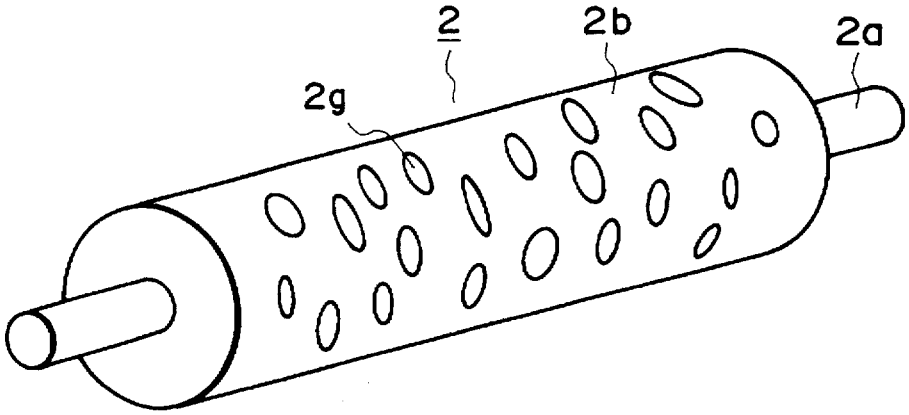
FIG. 15 is a perspective view illustrating another configuration of the voids in the surface of the foamed material.

Subsequently, the observations have been made for the case in which the voids 2g are oval which is long along a circumferential direction of the charging roller. An example of such voids are shown in FIG. 15.

The inside surface of the tube 2*c* is roughened randomly in the circumferential and longitudinal directions by a sand paper. A conductive rubber which is a material of the foamed material 2*b* and the core metal 2*a* are inserted, and integral foaming is carried out, by which the voids 2*g* long in the circumferential direction are produced. It is added here that if it is roughened only in the circumferential direction, the escape for the air extends only in the circumferential direction with the result that the void 2*g* extends all around the circumference.

FIG. 16 shows an interrelationship between the maximum diameter of the voids 2*g* and the image evaluation. In the case of the oval void 2*g* having a circumferential long axis, if the maximum diameter is not more than 5 mm, the improper charging does not occur.

Figure 17:
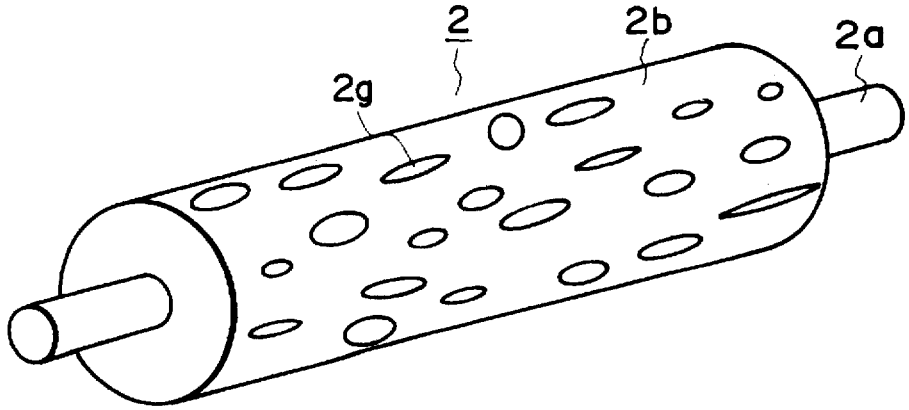
FIG. 17 is a perspective view illustrating a further configuration of the voids in the surface of the foamed material.

In addition, the observations have been made for the case in which the voids 2*g* have an oval configuration which is long along the length of the charging roller. An example of such voids 2*g* is shown in FIG. 17.

In the inside surface of the tube 2*c* about 150 grooves having a height of 0.3 mm are formed in the longitudinal direction. The core metal 2*a* and conductive rubber which is the material for the foamed material 2*b* are inserted, and the integral foaming is carried out, by which oval voids 2*g* which is long in the longitudinal direction are provided.

FIG. 18 shows the relation between the maximum diameter of the voids 2*g* and the image evaluation. As contrasted to the above-described embodiment, the improper charging does not occur if the longer side length of the void 2*g* is not less than approx. 7 mm.

It will be understood that the improper charging tends to occur when the voids 2*g* are long in the circumferential direction.

In the foregoing, three void configurations are investigated, and as a result, if the maximum diameter of the voids 2*g* is less than 5 mm, satisfactory images can be provided at all times.

The thickness and the hardness of the tube 2*c* of the charging roller 2 are changed, and the investigations have been made as to the interrelation between the voids and the image.

Figure 19:
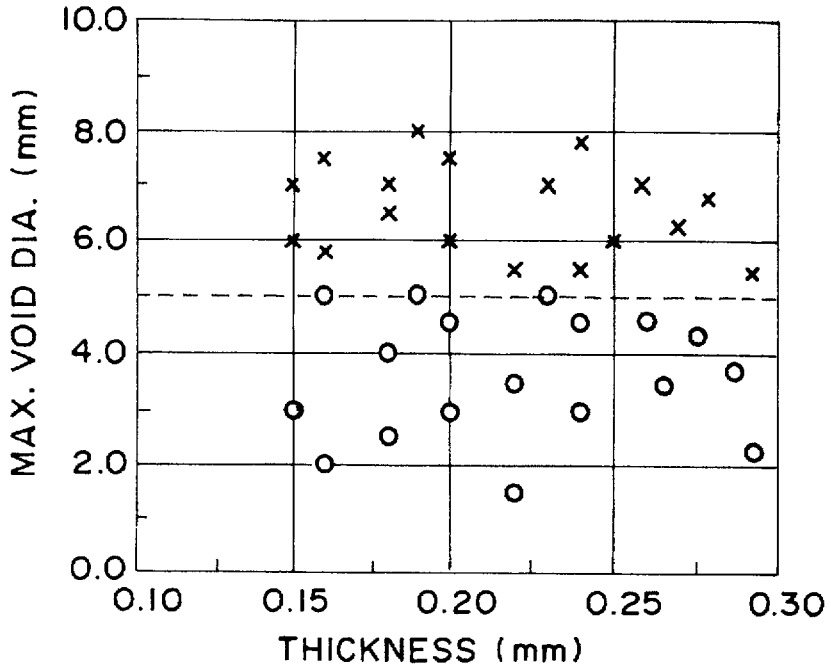
FIG. 19 is a graph showing a relationship between a thickness of a tube and a maximum diameter of the voids.
Figure 20:
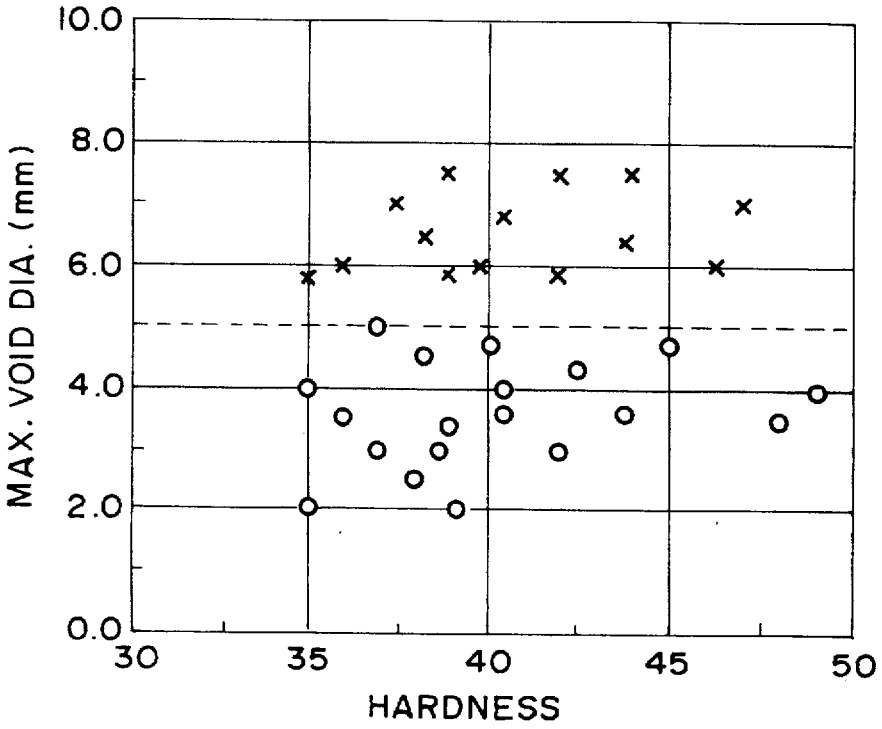
FIG. 20 is a graph showing a relationship between a hardness of the tube and a maximum diameter.

FIGS. 19 and 20 show the relation between the maximum diameter of the voids 2*g* and the improper charging when the thickness and the hardness of the tube 2*c* are changed. In the Figure "G" indicates satisfactory image, and "NG" indicates occurrence of improper charging.

The charging roller 2 used with respect to FIG. 19 is similar to that of Embodiment 2. The hardness thereof is approx. 40 degrees (IRHD), and the thickness of the tube 2*c* is changed. As to the thickness of the tube 2*c*, it is difficult to manufacture a thin tube 2*c* having a thickness of 0.15 mm or lower because of the stability in the manufacturing of the tube 2*c*. From the standpoint of the charging noise, the tube is not proper if the thickness thereof is 0.3 mm or larger. For this reason, the relation between the maximum void diameter and the image is investigated in the range of 0.15 mm–0.3 mm of the tube. As will be understood from the Figure, the satisfactory images can be provided if the maximum diameter of the voids 2*g* is not more than 5 mm, irrespectively of the thickness of the tube 2*c*.

The charging roller 2 related to FIG. 20 is similar to that of Embodiment 2, and the thickness of the tube 2*c* is approx. 0.25 mm. The hardness is the international rubber hardness (IRHD). With respect to the hardness, it is changed in the range between approx. 30 degrees and approx. 50 degrees. It has been found that the maximum diameter of the voids 2*g* for satisfactory images is 5 mm. When the international rubber hardness of the tube 2*c* is lower than 30 degrees, the fatigue of the charging roller is not easily restored, when the apparatus is left with no rotation of the charging roller or the photosensitive member, with the possibility of result of improper charging. Therefore, it is preferable that the rubber hardness (IRHD) is not less than 30 degrees.

As described in the foregoing, the maximum diameter of the voids 2*g* is preferably not more than 5 mm in order to provide satisfactory images. The advantages are particularly remarkable when the thickness of the tube is not less than 0.15 mm and not more than 0.3 mm, or the IRHD hardness of the charging roller 2 is not more than 30 degrees. The ranges are practical from the standpoint of manufacturing the charging roller 2. In order to permit stabilized manufacturing of the tube 2*c*, and in order to avoid the problem of the charging noise when an AC voltage is applied, the above-described range is most suitable.

In addition, combinations of Embodiments 1–4 are possible. Particularly, it is desirable that the Asker-C hardness of the surface of the charging member is 55 degrees or lower, the IRHD hardness is 80 degrees or lower, the tensile stress when the tube member is expanded by 100% is 100 kgf/cm$^2$ or higher, and the maximum diameter of the voids in the outer surface of the foamed member is 5 mm or smaller.

The description will be made as to an example in which the charging members according to Embodiments 1–4, are incorporated in a process cartridge detachably mountable to an image forming apparatus, and the image bearing member is charged by the charging member.

Figure 21:
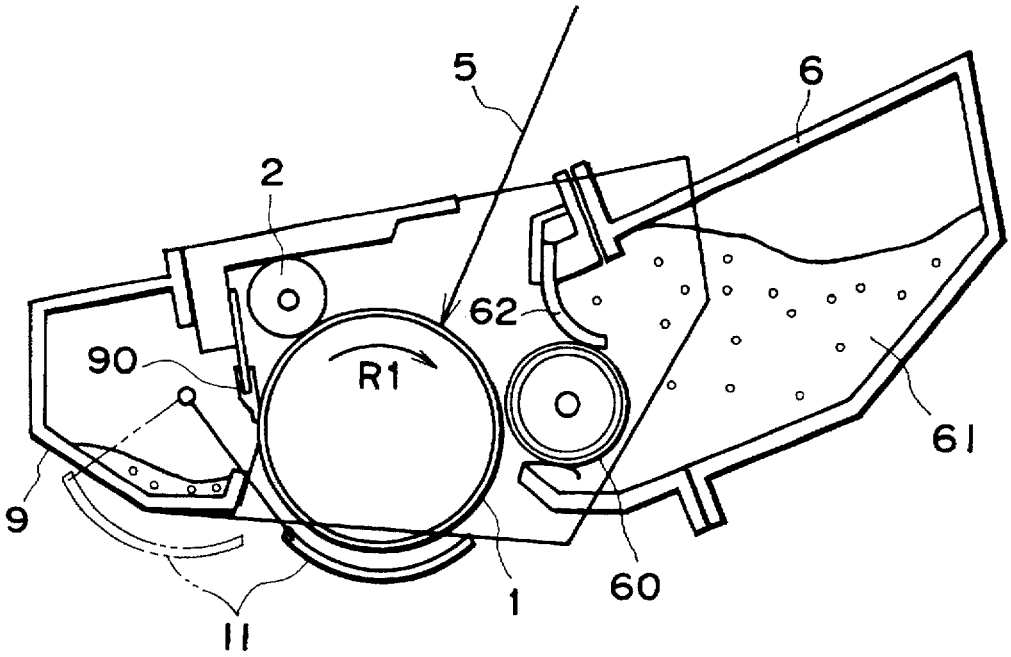
FIG. 21 is a cross-sectional view of a process cartridge.

In the process cartridge for an image forming apparatus, the charging member of any one of this embodiment is used as a charging means for charging the image bearing member. FIG. 21 shows a structure of the process cartridge.

The process cartridge comprises an electrophotographic photosensitive member in the form of a rotatable drum as an image bearing member, a charging roller 2 as a contact charging member, a developing device 6, and cleaning device 9 (four process means). However, the process cartridge may contain at least the photosensitive member 1 and the charging member 2.

The charging roller 2 is the same as any one of those of Embodiments 1, 2, 3 or 4.

The developing device 6 comprises a developing sleeve 60, a developer (toner) 61, a developing blade for applying the developer on the developing sleeve 6 in a uniform thickness.

The cleaning device 9 includes a cleaning blade 90.

Designated by a reference numeral 11 is a drum shutter, and is openable from the closing position indicated by the solid line to the open position indicated by the broken line. When the process cartridge is taken out of the main assembly of the image forming apparatus (not shown), it is in the closed position indicated by the solid line, and it protects the surface of the photosensitive drum by covering the exposed surface of the photosensitive drum 1.

When the process cartridge is mounted in the main assembly of the image forming apparatus, the shutter 11 is opened as indicated by the broken line, or the shutter 11 is automatically opened in the mounting process of the process cartridge. When the process cartridge is mounted in place, the exposed portion of the photosensitive drum 1 is press-contacted to a transfer roller 8 in the main assembly of the image forming apparatus.

The process cartridge is coupled with the main assembly of the image forming apparatus mechanically and electrically, by which the photosensitive drum 1, the developing sleeve 60 and the like can be operated by the driving mechanism in the main assembly of the image forming apparatus. In addition, the application of the charging bias voltage to the charging roller 2 and the application of the developing bias voltage to the developing sleeve 20 or the like are enabled from the voltage source (electric circuit) in the main assembly through electrodes. Therefore, the image forming operations is enabled.

Designated by a reference numeral 5 is a laser beam introduced from a laser scanner (not shown) in the main assembly, and it is projected into the process cartridge on the surface of the rotating photosensitive drum 1 to scan therewith.

Since the charging process means is not fixed in the laser beam printer main assembly, but it is in the process cartridge detachably mountable thereto, the vibration produced by the beating of the photosensitive drum by the charging roller is easily propagated over the entirety of the process cartridge, and therefore, the charging noise is amplified. Therefore, the beat of the charging noises which is one of the problems underlying the present invention is amplified with the result of further uncomfortable noise. However, by the use of the charging roller having the structure described above, the charging noise can be suppressed significantly even if an oscillating voltage is applied, and therefore, the charging noise can not be hard. In addition, compact process cartridge can be provided with high image quality without improper charging or the like.

As described in the foregoing, according to the present invention, the charging noise can be sufficiently reduced, and the fusing of the toner on the surface of the charging member can be prevented.

In addition, the charging roller exhibit small fatigue and exhibits satisfactory surface property so that the occurrence of the improper charging can be prevented.

In addition, the toner stagnation can be suppressed, and therefore, improper charging can be avoided.

Thus, quite image forming apparatus capable of providing high quality image, can be provided.

The voltage applied to the charging member is preferably a voltage having a periodically changing voltage level, and the waveform of the oscillating voltage may be a sine wave, a triangular wave or rectangular wave or the like. The oscillating voltage may be a combination of a DC voltage and an AC voltage provided by rendering on and off a DC voltage. In order to prevent spot like non-uniformity of charging of the member to be charged, the peak-to-peak voltage of the oscillating voltage is preferably not less than twice the charge starting voltage of the member to be charged. The charge starting voltage is a DC voltage when the charging of the member to be charged starts when only a DC voltage is applied between the charging member and the member to be charged and is gradually increased.

While the invention has been described with reference to the structures disclosed herein, it is not confined to the details set forth and this application is intended to cover such modifications or changes as may coma within the purposes of the improvements or the scope of the following claims.

What is claimed is:

1. A charging member for charging a member to be charged, comprising:

a base member;

a surface elastic member supported by said base member, said elastic member comprises a foamed member and a coating layer covering the foamed member;

wherein a surface of said charging member has an Asker-C hardness of not more than 55 degrees and an international rubber hardness (IRHD) of not more than 80 degrees.

2. A member according to claim 1, wherein said coating layer comprises a tube formed so that the foamed member is coated therewith.

3. A member according to claim 2, wherein said coating layer further comprises a conductive layer and a resistance layer outside the tube in this order.

4. A member according to claim 2, wherein a tensile stress of said tube when it is expanded by 100% is not less than 100 $kgf/cm^2$.

5. A member according to claim 2, wherein a maximum diameter of voids formed between a surface of said foamed member and an internal surface of said tube is not more than 5 mm.

6. A member according to claim 2, wherein said tube has a thickness of not less than 0.15 mm and not more than 0.3 mm.

7. A member according to claim 2, wherein said tube is provided with an inward tapered portion toward a longitudinal end, adjacent a longitudinal end of said charging member.

8. A member according to claim 1, wherein the international rubber hardness is not less than 30 degrees.

9. A member according to claim 1, wherein said charging member is capable of being supplied with a voltage.

10. A member according to claim 9, wherein the voltage is an oscillating voltage.

11. A member according to claim 9, wherein the voltage is in the form of a DC biased AC voltage.

12. A member according to claim 1, wherein said coating layer has a volume resistivity larger than that of said foamed member.

13. A member according to any one of claims 1–12, wherein said charging member is in the form of a roller.

14. A member according to any one of claims 1–12, wherein said charging member is contactable to a member to be charged for charging the member to be charged.

15. A charging member for charging a member to be charged, comprising:

a base member; and a surface elastic member supported by said base member, said elastic member including a foamed member and a coating layer outside said foamed member;

wherein said coating layer comprises a tube formed so that the formed member is coated therewith; and wherein when said tube is expanded by 100%, a tensile stress thereof is not less than 100 kgf/cm$^2$.

16. A member according to claim 15, wherein said charging member is capable of being supplied with a voltage.

17. A member according to claim 16, wherein the voltage is an oscillating voltage.

18. A member according to claim 16, wherein the voltage is in the form of a DC biased AC voltage.

19. A member according to claim 15, wherein said coating layer has a volume resistivity larger than that of said foamed member.

20. A member according to claim 15, wherein said coating layer further comprises a conductive layer and a resistance layer outside the tube in this order.

21. A member according to claim 15, wherein a maximum diameter of voids formed between a surface of said foamed member and an internal surface of said tube is not more than 5 mm.

22. A member according to claim 15, wherein said tube has a thickness of not less than 0.15 mm and not more than 0.3 mm.

23. A member according to claim 15, wherein said tube is provided with an inward tapered portion toward a longitudinal end, adjacent a longitudinal end of said charging member.

24. A member according to any one of claims 15–23, wherein said charging member is in the form of a roller.

25. A member according to any one of claims 15–23, wherein said charging member is contactable to a member to be charged for charging the member to be charged.

26. A charging member for charging a member to be charged, comprising:

a base member; and a surface elastic member supported by said base member, said elastic member including a foamed member and a coating layer outside said foamed member;

wherein said coating layer is provided with a tube by which said foamed member is coated; and wherein a maximum diameter of voids formed between a surface of said foamed member and an internal surface of said tube is not more than 5 mm.

27. A member according to claim 26, wherein said charging member is capable of being supplied with a voltage.

28. A member according to claim 27, wherein the voltage is an oscillating voltage.

29. A member according to claim 27, wherein the voltage is in the form of a DC biased AC voltage.

30. A member according to claim 27, wherein said coating layer has a volume resistivity larger than that of said foamed member.

31. A member according to claim 26, wherein said coating layer further comprises a conductive layer and a resistance layer outside the tube in this order.

32. A member according to claim 26, wherein said tube has a thickness of not less than 0.15 mm and not more than 0.3 mm.

33. A member according to claim 26, wherein said tube is provided with an inward tapered portion toward a longitudinal end, adjacent a longitudinal end of said charging member.

34. A member according to any one of claims 26–33, wherein said charging member is in the form of a roller.

35. A member according to any one of claims 26–33, wherein said charging member is contactable to a member to be charged for charging the member to be charged.

36. A member according to claim 26, wherein a groove is formed in a boundary between a surface of said foamed member and an inside surface of said tube.

37. A charging device for charging a member to be charged, comprising:

a charging member contactable to the member to be charged to charge it, said charging member comprising:

a base member, a surface elastic member supported by said base member, said elastic member including a foamed member and a coating layer for covering said foamed member;

means for permitting application of a voltage between said charging member and the member to be charged:

wherein a surface of said charging member has an Asker-C hardness of not higher than 55 degrees, and an international rubber hardness (IRHD) of not higher than 80 degrees.

38. A device according to claim 37, wherein said coating layer comprises a tube formed so that the foamed member is coated therewith.

39. A device according to claim 38, wherein said coating layer further comprises a conductive layer and a resistance layer outside the tube in this order.

40. A device according to claim 38, wherein a tensile stress of said tube when it is expanded by 100% is not less than 100 kgf/cm$^2$.

41. A device according to claim 38, wherein a maximum diameter of voids formed between a surface of said foamed member and an internal surface of said tube is not more than 5 mm.

42. A device according to claim 38, wherein said tube has a thickness of not less than 0.15 mm and not more than 0.3 mm.

43. A device according to claim 38, wherein said tube is provided with an inward tapered portion toward a longitudinal end, adjacent a longitudinal end of said charging member.

44. A device according to claim 37, wherein the international rubber hardness is not less than 30 degrees.

45. A device according to claim 37, wherein the voltage is an oscillating voltage.

46. A device according to claim 37, wherein the voltage is in the form of a DC biased AC voltage.

47. A device according to claim 37, wherein said coating layer has a volume resistivity larger than that of said foamed member.

48. A device according to any one of claims 37–47, wherein said charging member is in the form of a roller.

49. A device according to any one of claims 37–47, wherein said charging device is used for charging an image bearing member in an image forming apparatus.

50. A charging device for charging a member to be charged, comprising:

a charging member contactable to the member to be charged to charge same, said charging member comprising:

a base member, a surface elastic member supported by said base member, said elastic member including a foamed member and a coating layer for covering said foamed member;

means for permitting application of a voltage between said charging member and the member to be charged;

wherein said coating layer is provided with a tube formed so that said foamed member is coated therewith, and wherein when said tube is expanded by 100%, a tensile stress thereof is not less than 100 kgf/cm$^2$.

51. A device according to claim 50, wherein the voltage is an oscillating voltage.

52. A device according to claim 50, wherein the voltage is in the form of a DC biased AC voltage.

53. A device according to claim 50, wherein said coating layer has a volume resistivity larger than that of said foamed member.

54. A device according to claim 50, wherein said coating layer further comprises a conductive layer and a resistance layer outside the tube in this order.

55. A device according to claim 50, wherein a maximum diameter of voids formed between a surface of said foamed member and an internal surface of said tube is not more than 5 mm.

56. A device according to claim 50, wherein said tube has a thickness of not less than 0.15 mm and not more than 0.3 mm.

57. A device according to claim 50, wherein said tube is provided with an inward tapered portion toward a longitudinal end, adjacent a longitudinal end of said charging member.

58. A device according to any one of claims 50–57, wherein said charging member is in the form of a roller.

59. A device according to any one of claims 50–57, wherein said charging device is used for charging an image bearing member in an image forming apparatus.

60. A charging device for charging a member to be charged, comprising:

a charging member contactable to the member to be charged to charge same, said charging member comprising:

a base member, a surface elastic member supported by said base member, said elastic member including a foamed member and a coating layer for covering said foamed member;

means for permitting application of a voltage between said charging member and the member to be charged;

wherein said coating layer is provided with a tube formed so that said foamed member is coated therewith, and wherein a maximum diameter of voids formed between a surface of said foamed member and an internal surface of said tube is not more less than 5 mm.

61. A device according to claim 60, wherein the voltage is an oscillating voltage.

62. A device according to claim 60, wherein the voltage is in the form of a DC biased AC voltage.

63. A device according to claim 60, wherein said coating layer lids a volume resistivity larger than that of said foamed member.

64. A device according to claim 60, wherein said coating layer further comprises a conductive layer and a resistance layer outside the tube in this order.

65. A device according to claim 60, wherein said tube has a thickness of not less than 0.15 mm and not more than 0.3 mm.

66. A device according to claim 60, wherein said tube is provided with an Inward tapered portion toward a longitudinal end, adjacent a longitudinal end of said charging member.

67. A device according to any one of claims 60–66, wherein said charging member is in the form of a roller.

68. A device according to any one of claims 60–66, wherein said charging device is used for charging an image bearing member in an image forming apparatus.

69. A member according to claim 60, wherein a groove is formed in a boundary between a surface of said foamed member and an inside surface of said tube.

70. A process cartridge detachably mountable to an image forming apparatus, comprising:

a member to be charged capable of bearing an image;

a charging member contactable to said member to be charged for charging said member to be charged, wherein a voltage is capable of being applied between said charging member and said member to be charged from a voltage source of a main assembly of said apparatus, said charging member including;

a base member;

a surface elastic member supported by said base member, said elastic member comprises a foamed member and a coating layer covering the foamed member;

wherein a surface of said charging member has an Asker-C hardness of not more than 55 degrees and an international rubber hardness (IRHD) of not more than 80 degrees.

71. A process cartridge according to claim 70, wherein said coating layer comprises a tube formed so that the foamed member is coated therewith.

72. A process cartridge according to claim 71, wherein said coating layer further comprises a conductive layer and a resistance layer outside the tube in this order.

73. A process cartridge according to claim 71, wherein a tensile stress of said tube when it is expanded by 100% is not less than 100 kgf/cm$^2$.

74. A process cartridge according to claim 71, wherein a maximum diameter of voids formed between a surface of said foamed member and an internal surface of said tube is not more than-5 mm.

75. A process cartridge according to claim 71, wherein said tube has a thickness of not less than 0.15 mm and not more than 0.3 mm.

76. A process cartridge according to claim 71, wherein said tube is provided with an inward tapered portion toward a longitudinal end, adjacent a longitudinal end of said charging member.

77. A process cartridge according to claim 70, wherein the international rubber hardness is not less than 30 degrees.

78. A process cartridge according to claim 70, wherein the voltage is an oscillating voltage.

79. A process cartridge according to claim 70, wherein the voltage is in the form of a DC biased AC voltage.

80. A process cartridge according to claim 70, wherein said coating layer has a volume resistivity larger than that of said foamed member.

81. A process cartridge according to any one of claims 70–80, wherein said charging member is in the form of a roller.

82. A process cartridge according to any one of claims 70–80, wherein said member to be charged is an electrophotographic photosensitive member.

83. A process cartridge according to claim 80, further comprising a developing device for developing said electrophotographic photosensitive member.

84. A process cartridge detachably mountable to an image forming apparatus, comprising:

a member to be charged capable of bearing an image;

a charging member contactable to said member to be charged for charging said member to be charged, wherein a voltage is capable of being applied between said charging member and said member to be charged from a voltage source of a main assembly of said apparatus, said charging member including:

a base member; and a surface elastic member supported by said base member, said elastic member including a foamed member and a coating layer outside said foamed member;

wherein said coating layer is provided with a tube formed so that said foamed layer is coated thereby; and wherein when said tube is expanded to 100%, a tensile stress thereof is not less than 100 kgf/cm$^2$.

85. A process cartridge according to claim 84, wherein the voltage is an oscillating voltage.

86. A process cartridge according to claim 84, wherein the voltage is in the form of a DC biased AC voltage.

87. A process cartridge according to claim 84, wherein said coating layer has a volume resistivity larger than that of said foamed member.

88. A process cartridge according to claim 84, wherein said coating layer further comprises a conductive layer and a resistance layer outside the tube in this order.

89. A process cartridge according to claim 84, wherein a maximum diameter of voids formed between a surface of said foamed member and an internal surface of said tube is not more than 5 mm.

90. A process cartridge according to claim 84, wherein said tube has a thickness of not less than 0.15 mm and not more than 0.3 mm.

91. A process cartridge according to claim 84, wherein said tube is provided with an inward tapered portion toward a longitudinal end, adjacent a longitudinal end of said charging member.

92. A process cartridge according to any one of claims 84–91, wherein said charging member is in the form of a roller.

93. A process cartridge according to any one of claims 84–91, wherein said member to be charged is an electrophotographic photosensitive member.

94. A process cartridge according to claim 93, further comprising a developing device for developing said electrophotographic photosensitive member.

95. A process cartridge detachably mountable to an image forming apparatus, comprising:

a member to be charged capable of bearing an image;

a charging member contactable to said member to be charged for charging said member to be charged, wherein a voltage is capable of being applied between said charging member and said member to be charged from a voltage source of a main assembly of said apparatus, said charging member including:

a base member; and a surface elastic member supported by said base member, said elastic member including a foamed member and a coating layer outside said foamed member;

wherein said coating layer is provided with a tube formed so that said foamed member is coated thereby; and wherein a maximum diameter of voids formed on such a surface of said foamed member and an internal surface of said tube is not more than 5 mm.

96. A process cartridge according to claim 95, wherein the voltage is an oscillating voltage.

97. A process cartridge according to claim 95, wherein the voltage is in the form of a DC biased AC voltage.

98. A process cartridge according to claim 95, wherein said coating layer has a volume resistivity larger than that of said foamed member.

99. A process cartridge according to claim 95, wherein said coating layer further comprises a conductive layer and a resistance layer outside the tube in this order.

100. A process cartridge according to claim 95, wherein said tube has a thickness of not less than 0.15 mm and not more than 0.3 mm.

101. A process cartridge according to claim 95, wherein said tube is provided with an inward tapered portion toward a longitudinal end, adjacent a longitudinal end of said charging member.

102. A process cartridge according to any one of claims 95–101, wherein said charging member is in the form of a roller.

103. A process cartridge according to any one of claims 95–101, wherein said member to be charged is an electrophotographic photosensitive member.

104. A process cartridge according to claim 103, further comprising a developing device for developing said electrophotographic photosensitive member.

105. A member according to claim 95, wherein a groove is formed in a boundary between a surface of said foamed member and an inside surface of said tube.

106. A charging member for charging a member to be charged, comprising:

a base member;

a surface elastic member supported by said base member, said elastic member including a foamed member and a coating layer outside said foamed member;

wherein said coating layer is provided with a tube formed so that said foamed member is coated thereby; and wherein said tube is provided with an inward tapered portion toward a longitudinal end, adjacent a longitudinal end of said charging member.

107. A member according to claim 106, wherein said charging member is capable of being supplied with a voltage.

108. A member according to claim 107, wherein the voltage is an oscillating voltage.

109. A member according to claim 106, wherein said coating layer has a volume resistivity larger than that of said foamed member.

110. A member according to claim 106, wherein said tube has a thickness of not less than 0.15 mm and not more than 0.3 mm.

111. A member according to claim 106, wherein said charging member is in the form of a roller.

112. A member according to any one of claims 106 to 108, wherein said charging member is contactable to a member to be charged for charging the member to be charged.

113. A charging device for charging a member to be charged, comprising:

a charging member contactable to the member to be charged to charge said member, said charging member comprising:

a base member, a surface elastic member supported by said base member, said elastic member including a foamed member and a coating layer outside said foamed member;

means for permitting application of a voltage between said charging member and the member to be charged;

wherein said coating layer is provided with a tube formed so that said foamed member is coated thereby; and wherein said tube is provided with an inward tapered portion toward a longitudinal end, adjacent a longitudinal end of said charging member.

114. A device according to claim 113, wherein the voltage is an oscillating voltage.

115. A device according to claim 113, wherein said coating layer comprises a conductive layer and a resistance layer outside the tube in this order.

116. A device according to claim 113, wherein said tube has a thickness of not less than 0.15 mm and not more than 0.3 mm.

117. A device according to claim 113, wherein said charging member is in the form of a roller.

118. A device according to any one of claims 113 to 117, wherein said charging device is used for charging an image bearing member in an image forming apparatus.

119. A process cartridge detachably mountable to an image forming apparatus, comprising:

a member to be charged capable of bearing an image;

a charging member contactable to said member to be charged for charging said member to be charged, wherein a voltage is capable of being applied between said charging member and said member to be charged from a voltage source of a main assembly of said apparatus, said charging member including:

a base member;

a surface elastic member supported by said base member, said elastic member comprising a foamed member and a coating layer outside the foamed member;

wherein said coating layer is provided with a tube formed so that said foamed member is coated thereby; and wherein said tube is provided with an inward tapered portion toward a longitudinal end, adjacent a longitudinal end of said charging member.

120. A process cartridge according to claim 119, wherein the voltage is an oscillating voltage.

121. A process cartridge according to claim 119, wherein said coating layer comprises a conductive layer and a resistance layer outside the tube in this order.

122. A process cartridge according to claim 119, wherein said tube has a thickness of not less than 0.15 mm and not more than 0.3 mm.

123. A process cartridge according to claim 119, wherein said charging member is in the form of a roller.

124. A process cartridge according to any one of claims 119 to 123, wherein said member to be charged is an electrophotographic photosensitive member.

125. A process cartridge according to claim 124, further comprising a developing device for developing said electrophotographic member.

126. A charging member in the form of a roller, which is contactable to an electrophotographic photosensitive drum to charge the electrophotographic photosensitive drum and which is capable of being supplied with an AC biased DC voltage, said charging member comprising:

a base member capable of being supplied with the AC biased DC voltage; and a surface elastic member supported by said base member, said surface elastic member having a foamed member and a coating layer covering said foamed member, wherein a surface of said charging member has an Asker-C hardness of not more than 55 degrees and an international rubber hardness, IRHD, of not more than 80 degrees.

127. A member according to claim 126, wherein said coating layer comprises a tube formed so that the foamed member is coated therewith.

128. A member according to claim 127, wherein said coating layer further comprises a conductive layer and a resistance layer outside the tube in this order.

129. A member according to claim 127, wherein a tensile stress of said tube when it is expanded by 100% is not less than 100 kfg/cm$^2$.

130. A member according to claim 127, wherein a maximum diameter of voids formed between a surface of said foamed member and an internal surface of said tube is not more than 5 mm.

131. A member according to claim 127, wherein said tube has a thickness of not loss than 0.15 mm and not more than 0.3 mm.

132. A member according to claim 127, wherein said tube is provided with an inward tapered portion toward a longitudinal and, adjacent a longitudinal end of said charging member.

133. A member according to claim 126, wherein the international rubber hardness is not less than 30 degrees.

134. A member according to claim 126, wherein said coating layer has a volume resistivity larger than that of said foamed member.

135. A charging member in the form of a roller, which in contactable to an electrophotographic photosensitive drum to charge the electrophotographic photosensitive drum and which is capable of being supplied with an AC biased DC voltage, said charging member comprising:

a base member capable of being supplied with the AC biased DC voltage; and a surface elastic member supported by said base member, said surface elastic member including a foamed member and a coating layer outside said foamed member, wherein said coating layer comprises a tube formed so that said foamed member is coated therewith, and wherein, when said tube is expanded by 100%, a tensile stress thereof is not less than 100 kgf/cm$^2$.

136. A member according to claim 135, wherein said coating layer has a volume resistivity larger than that of said foamed member.

137. A member according to claim 135, wherein said coating layer further comprises a conductive layer and a resistance layer outside the tube in this order.

138. A member according to claim 135, wherein a maximum diameter of voids formed between a surface of said foamed member and an internal surface of said tube is not more than 5 mm.

139. A member according to claim 135, wherein said tube has a thickness or not less than 0.15 mm and not more than 0.3 mm.

140. A member according to claim 135, wherein said tube is provided with an inward tapered portion toward a longitudinal end, adjacent a longitudinal end of said charging member.

141. A charging member in the form of a roller, which is contactable to an electrophotographic photosensitive drum to charge the electrophotographic photosensitive drum and which is capable of being supplied with an AC biased DC voltage, said charging member comprising:

a base member capable of being supplied with the AC biased DC voltage; and a surface elastic member supported by said base member, said surface elastic member including a foamed member and a coating layer outside said foamed member, wherein said coating layer is provided with a tube by which said foamed member is coated, and wherein a maximum diameter of voids formed between a surface of said foamed member and an internal surface of said tube is not more than 5 mm.

142. A member according to claim 141, wherein said coating layer has a volume resistivity larger than that of said foamed member.

143. A member according to claim 141, wherein said coating layer further comprises a conductive layer and a resistance layer outside the tube in this order.

144. A member according to claim 141, wherein said tube has a thickness of not less than 0.15 mm and not more than 0.3 mm.

145. A member according to claim 141, wherein said tube is provided with an inward tapered portion toward a longitudinal end, adjacent a longitudinal and of said charging member.

146. A charging member in the form of a roller, which is contactable to an electrophotographic photosensitive drum to charge the electrophotographic photosensitive drum and which is capable of being supplied with an AC biased DC voltage, said charging member comprising:

a base member capable of being supplied with the AC biased DC voltage; and a surface elastic member supported by said base member, said surface elastic member including a foamed member and a coating layer outside said foamed member, wherein said coating layer is provided with a tube formed so that said foamed member is coated thereby, and wherein said tube is provided with an inward tapered portion toward a longitudinal end, adjacent a longitudinal and of said charging member.

147. A member according to claim 146, wherein said coating layer has a volume resistivity larger than that of said foamed member.

148. A member according to claim 146, wherein said tube has a thickness of not less than 0.15 mm and not more than 0.3 mm.

* * * * *

UNITED STATES PATENT AND TRADEMARK OFFICE

CERTIFICATE OF CORRECTION

PATENT NO. : 5,765,077

DATED : June 9, 1998

INVENTOR(S) : KAZUSHIGE SAKURAI ET AL.

It is certified that error appears in the above-identified patent and that said Letters Patent is hereby corrected as shown below:

Title page;

[56] REFERENCES CITED

Foreign Patent Documents
"1066673" should read --1-066673--.
"1179957" should read --1-179957--.
"0308125" should read --0308185--.

COLUMN 1

Line 39, "predetermined namely" should read --predetermined direction namely--.

COLUMN 4

Line 59, "the use is made with" should read --use is made of--.

COLUMN 5

Line 4, "like" should read --like.--.
Line 5, "the use is made with" should read --use is made of--.
Line 29, "an" should be deleted.

COLUMN 6

Line 44, "decreased" should read --decreases--.

UNITED STATES PATENT AND TRADEMARK OFFICE

CERTIFICATE OF CORRECTION

PATENT NO. : 5,765,077

DATED : June 9, 1998

INVENTOR(S) : KAZUSHIGE SAKURAI ET AL.

It is certified that error appears in the above-identified patent and that said Letters Patent is hereby corrected as shown below:

COLUMN 7

Line 4, "a" should read --α--.
Line 35, "epichlarohydrin" should read --epichlorohydrin--.
Line 67, "and" should be deleted.

COLUMN 8

Line 1, "therefore, the" should be deleted.
Line 9, "The use is made with" should read --Use is made of--.
Line 31, "strength" should read --strength of--.

COLUMN 9

Line 5, "call" should read --a cell.--.
Line 11, "2 g" should read --2g--.
Line 23, "a sand" should be deleted.
Line 24, "paper." should read --sandpaper.--.
Line 47, "is" should read --are--.

COLUMN 10

Line 52, "this embodiment" should read --these embodiments--.

UNITED STATES PATENT AND TRADEMARK OFFICE

CERTIFICATE OF CORRECTION

PATENT NO. : 5,765,077

DATED : June 9, 1998

INVENTOR(S) : KAZUSHIGE SAKURAI ET AL.

It is certified that error appears in the above-identified patent and that said Letters Patent is hereby corrected as shown below:

COLUMN 11

Line 28, "is" should read --are--.
Line 47, "hard." should read --heard.--
Line 54, "exhibit" should read --exhibits--.
Line 59, "quite" should read --a quiet--.
Line 60, "image, can" should read --images can--.

COLUMN 15

Line 42, "less" should be deleted.
Line 48, "lids" should read --has--.
Line 57, "Inward" should read --inward--.

COLUMN 16

Line 29, "than-5" should read --than 5--.

COLUMN 20

Line 4, "loss" should read --less--.

UNITED STATES PATENT AND TRADEMARK OFFICE

CERTIFICATE OF CORRECTION

PATENT NO. : 5,765,077

DATED : June 9, 1998

INVENTOR(S) : KAZUSHIGE SAKURAI ET AL.

It is certified that error appears in the above-identified patent and that said Letters Patent is hereby corrected as shown below:

COLUMN 21

Line 6, "and" should read --end--.

Signed and Sealed this

Ninth Day of March, 1999

*Attest:*

*Attesting Officer*

Q. TODD DICKINSON

*Acting Commissioner of Patents and Trademarks*